United States Patent [19]

Wright, III

[11] 4,137,585

[45] Feb. 6, 1979

[54] BUOYANCY COMPENSATOR AND INFLATION SYSTEM

[75] Inventor: William M. Wright, III, Mission Viejo, Calif.

[73] Assignee: U.S. Divers Co., Santa Ana, Calif.

[21] Appl. No.: 805,417

[22] Filed: Jun. 10, 1977

[51] Int. Cl.[2] ..... B63C 9/24

[52] U.S. Cl. ..... 9/314; 114/332; 9/342

[58] Field of Search ..... 9/311, 312, 314, 315, 9/316, 319, 322, 313, 329, 336, 338, 339, 341, 342; 61/6 R, 70, 71; 128/142 R, 142.2, 142.3, 142.4, 142.5, 145 R, 146.4, 146.5; 114/16 E; 224/25 A

[56] References Cited

U.S. PATENT DOCUMENTS

| | | | |
|---|---|---|---|
| 2,842,785 | 7/1958 | Sieverts | 9/342 |
| 3,065,888 | 11/1962 | Lande | 224/25 A |
| 3,436,777 | 4/1969 | Greenwood | 9/313 |
| 3,721,235 | 3/1973 | Ball et al. | 128/142.2 |
| 3,820,348 | 6/1974 | Fast | 114/16 E |
| 3,898,705 | 8/1975 | Schuler | 9/313 |

*Primary Examiner*—Trygve M. Blix
*Assistant Examiner*—Jesus D. Sotelo
*Attorney, Agent, or Firm*—George F. Bethel; Patience K. Bethel

[57] ABSTRACT

The following disclosure discloses a buoyancy compensator having an inflatable bladder at the front and rear of a diver, so that adequate buoyancy is provided with respect to the diver's entire torso. The buoyancy compensator has a strap and harness arrangement that incorporates securement of a backpack thereto for an underwater breathing gas tank that is strapped thereon. The buoyancy compensator includes a low pressure inflation system, an oral inflation member, and a valve for releasing excess pressure either through overexpansion or by manual articulation of the valve cover. A low pressure inflation system for the buoyancy compensator utilizes exhaust breathing gas for pressurization of the buoyancy compensator from the second stage regulator exhaust. The exhaust flow into the buoyancy compensator can be controlled as to pressure and displacement by a pressure relief valve and switching and valving manifold control system.

11 Claims, 16 Drawing Figures

BUOYANCY COMPENSATOR AND INFLATION SYSTEM

BACKGROUND OF THE INVENTION

1. Field of the Invention

The field of this invention lies within the diving equipment art. In particular, it resides within the buoyancy compensation art and more specifically, in the field of providing flotation to a diver with proper buoyancy compensation concommitant with the filling of the buoyancy compensator from a source of gas.

2. The Prior Art

The prior art related to buoyancy compensators, flotation devices, and means for filling such devices, incorporated a myriad of devices.

Initially, flotation devices for divers were generally of the aviator inflatable life jacket types, originally termed a Mae West. Such life jackets were usually formed of a canvas or duck type of material with a rubberized liner. The inflation of the devices such as the aviator life jacket, was accomplished in one of two ways. Firstly, an emergency means was generally provided by means of a gas cartridge, such as a $CO_2$ cartridge. The $CO_2$ cartridge was connected to the jacket in order to allow the discharge of gas thereinto after it had been punctured.

A second means of inflating the vest which was sometimes in combination or in singular form therewith, was in the form of a tubular oral inflator. The oral inflator incorporated valving means in different forms.

Since the time of the development of self contained underwater breathing apparatus and diving in general, the flotation devices of the prior art have been extensively developed. Initial utilization of life jackets by the diving profession was for safety purposes only. As time went on, they evolved into use for buoyancy compensation purposes.

Specifically, when a diver partakes in a dive, he uses weights and other various buoyancy offsetting and compensating means. In particular, waist belts are utilized in order to give a diver a certain degree of ability to overcome his positive buoyancy in his body as well as the cellular structure of his wetsuit.

In the past, it has been found that an ability to adjust one's buoyancy by various amounts of positively displacing gas is helpful. In particular, a diver in order to maintain a comfortable level, will oftentimes inflate a buoyancy compensator in order to trim his particular attitude and depth.

As time has evolved various forms of prior art buoyancy compensators, one thing has remained in common with all of them. This is the requirement for inflation in a facile and easy manner. Various means have been utilized, such as oral inflation means, low pressure gas from the diver's breathing gas supply, as well as emergency gas supply means in the form of $CO_2$ cartridges.

In addition to the foregoing design features, there have been a substantial number of relief valves and valves that are utilized to adjust the buoyancy compensator. In particular, relief valves in the form of overpressure valves and hand operated valves, are incorporated for purposes of relieving internal pressure.

Throughout all the foregoing developments however, there has usually been a requirement of maintaining a degree of displacement balance by the buoyancy compensator which was never accomplished. A balance between the flotation or positive buoyancy provided by the prior art buoyancy compensators could not be maintained by virtue of the fact that they usually fit on the front or the back of a diver.

The respective utilization of the front or back mounted buoyancy compensators did not allow for overall trimming of the diver's buoyancy for proper attitude control. This invention incorporates the novel feature of dual displacement at the front and back of a diver in order to provide for maintenance of buoyancy with respect to both the frontal and rear portions of a diver's torso.

In effect, the buoyancy in the water could be controlled. However, the desired rotational moment of the diver could not be controlled. A main feature of this invention is the configuration of the flotation cell both on the back and around the chest of the diver to allow for a positive turning moment of the complete compensator. This feature allows the equipment to possess the best features of a front and back compensator while eliminating adverse effects of both of these types of previously marketed equipment.

In some cases, a back-mounted compensator is preferred since it is easier for the diver to don and doff. This results in less cumbersome and complicated strapping arrangement around the diver's chest and torso. It also places the flotation cell at the diver's back so as to not create an uncomfortable upward pressure around the diver's neck or abdominal area during usage. However, the disadvantage of the back-mounted compensator is that it tends to place the diver in either a face-up or face-down position depending upon his orientation when he breaks the water's surface on ascent. If the diver is in a face-up condition, the lift at the diver's back can easily flip him to a face down condition. If he reaches the surface in a face-down condition, it is difficult for the diver to turn himself in a face-up orientation without first partially deflating a back-mounted compensator.

The front-mounted compensator has the advantage of being a basically safer type unit especially for an unconscious emergency type of an ascent in that it places the diver in a face-up head-out-of-the water position automatically when on the surface. The drawback to the front-mounted compensator is the additional strapping around a diver's waist and crotch which may interfere with his weight belt and backpack harnesses. Also, such units are uncomfortable on the diver's abdominal area and around the diver's neck when the compensator is fully inflated and the diver is on the surface, thereby restricting breathing.

Another important factor related to the prior art was that buoyancy compensators were usually used extrinsic to a backpack on which a cylinder of breathing gas was mounted. This invention incorporates the utilization of a buoyancy compensator for purposes of providing inherent combined backpack and buoyancy compensation functions. Also, the prior art usually incorporated shoulder harnesses and chest harnesses for securing the backpack to a diver. The chest and shoulder harnesses were particularly uncomfortable and served to ride into both the armpit area, as well as on top of the shoulder.

This invention overcomes the foregoing uncomfortable nature of the prior art harnesses by utilizing the buoyancy compensator as a support means. The buoyancy compensator forms a portion of the shoulder harness, so that the pneumatic relationship thereof causes the weight of the gas cylinder and backpack to be associated with the buoyancy compensator and loaded thereon. The buoyancy compensator even without inflation spreads the load more evenly across a diver's shoulders.

When the buoyancy compensator upon which the load is impressed upon a diver's shoulder is incorporated with the harness of this invention, it provides a comfortable and downward pull of the entire self contained underwater breathing apparatus. Thus, a comfortable and desirable loading is maintained in contradistinction to the prior art which provided a binding and gripping feeling to the shoulders and chest area.

The features that were particularly cumbersome and wasteful of breathing gas in the prior art with regard to filling a buoyancy compensator, evolved out of the low pressure filling system. This was due to the use of exhaust being difficult with existing oral inflation devices, thus requiring the use of good air to inflate the bag. Such low pressure filling systems incorporated tubular extensions from the low pressure side of a regulator to an oral inflation device or bag inflation device. The low pressure inflation device was usually in the form of a socket or tubular insertion member attached to the buoyancy compensator. The socket provided for an insertion and locking of a tubular extension from the low pressure side of the regulator for purposes of valving gas therefrom into the buoyancy compensator. The valving was caused by either the opening of a shrader valve or the opening of an alternative valving system of the socket or low pressure inflating fixture.

This invention overcomes the foregoing requirements by incorporating a completely different low pressure inflating system that can be attached to or fabricated as an integral part of a second stage regulator for exhaust gas inflation or low pressure inflation from a tubular member connected to the low pressure side of the first stage regulator.

A particularly important factor of the prior art was to have overpressure relief valve means, as well as means for manually changing the volume. The net result was to dump the gas at a given bladder pressure either through automatic poppet valve pressure relief means, or by a manually articulated valve. The manually articulated valve was utilized as a dumping valve for dumping gas to change the amount of flotation or positive buoyancy.

This invention overcomes the foregoing requirement by having a combination valve and relief system incorporated in the invention hereof. It also incorporates an alternative dump valve which is manually articulated through a draw string as shown in an alternative embodiment hereof.

Another feature of the invention that solves prior art oral inflation is the utilization of the second stage regulator exhaust air for filling purposes. The invention conducts the second stage exhaust gas from an exhaust mode into a mode whereby the exhaust gas fills the buoyancy compensator. In this manner, exhaust breathing gas is not wasted and can be used to control and fill the buoyancy compensator on an extended basis without depleting one's breathable gas. This is a very important feature when one considers that the ability of a diver to maintain himself under water is predicated upon his gas supply. Thus, any utilization of a diver's gas supply for flotation purposes is a relatively second priority relationship to gas for breathing purposes. As a consequence, this invention finds great utility in capturing gas and incorporating it as filling gas for a buoyancy compensator.

In addition to the foregoing feature of capturing the exhaust breathing gas, the apparatus attached to the second stage regulator can also be used for valving low pressure gas directly to the buoyancy compensator. The system also enables one to vary the amount of gas in two respective bladders.

The invention incorporates two pull cords which provide for pressure control of the bladder or respective dual bladders, to create a situation wherein various amounts of gas can be conducted into the bladder or bladders. The amount of gas can then be trimmed in accordance with a diver's requirements for buoyancy by merely changing the amount of air in the front or the back bladder by pulling on a string or cord.

From the foregoing, it can be seen that this invention overcomes the deficiencies of the prior art by providing for a combination buoyancy compensator which has the ability to provide positive buoyancy to the front and the back of a diver's torso. The buoyancy compensator has the built-in feature of supporting a breathing gas tank and attendant equipment on a diver's back with the backpack thereof being supported in part by the buoyancy compensator over the shoulders of a diver. The buoyancy compensator specifically has the ability to spread the load over a diver's shoulders and provide for an additional pneumatic cushioning of the backpack thereon. Additionally, the buoyancy compensator has a harness that holds the compensator downwardly. This effectuates a downward pull of the entire load to avoid binding on a user's underarms by the harness.

The buoyancy compensator incorporates a dump valve, oral inflator and emergency inflation means along with a low pressure inflator. Also, a single device allows for the conduction of exhaust gas from the second stage regulator to the buoyancy compensator, so that low pressure gas requirements are cut down, as well as providing definitive control of the gas in the bladder.

As can further be seen, a most important feature of this invention is the configuration of the buoyancy compensator bladders. It fundamentally allows a positive turning moment to a diver, so that he is placed in a head-up position without utilizing the uncomfortable solely front mounted buoyancy compensator configuration.

As a consequence, this invention overcomes the deficiencies of the prior art in a multitude of areas.

SUMMARY OF THE INVENTION

In summation, this invention incorporates a buoyancy compensator for control of a diver's buoyancy, at his front and back, as well as having filling means that recover the exhaust gas from the second stage regulator for purposes of filling the buoyancy compensator.

More particularly and in addition thereto, the buoyancy compensator has a bladder at the back that is joined to a front bladder by means of a vest or casing that fits over the shoulders of a diver. The vest is shaped like a satchel, with a pair of bladders or downward appendages in the form of a yoke.

The foregoing relationship provides balance and trimming to a diver utilizing the vest. The effect is to provide a positive turning moment to a diver to place him in a proper attitude. The featured configuration of the compensator bag has the advantage of a positive turning moment allowing the diver a head-up position in the water without the discomfort and chest pressure created by a frontal buoyancy compensator mounting configuration. It also has the advantages of a back mounted unit with its ease of body attachment and back mounted flotation cell location for greater underwater comfort.

In addition thereto, the vest in cooperation with the harness allows for securement of a backpack with a breathing gas tank on the back thereof in a comfortable manner. The shoulder seating is in a yoke configuration, so that it lies on the shoulders of a user in pneumatically supported relationship. At the same time, it causes the harness to be held on a diver's body to prevent binding on the shoulders and disproportionate loading on a diver's body.

A low pressure inflation means, dump valve, oral inflator and an emergency inflation means is provided. The foregoing is uniquely designed to provide proper filling and dumping of pressure either through overinflation or for trimming purposes.

A special feature incorporates the utilization of a conduit attached to a second stage regulator. The conduit conducts exhaust gas to a buoyancy compensator after exhalation for filling it. The exhaust gas is trapped from being exhausted by means of a valving button that returns the gas to the conduit leading to the buoyancy compensator. A coaxial conduit therewith allows for low pressure inflation from the low pressure tank supply when desired through a second valving system. The entire apparatus utilizes a pair of valves in a switching manifold to relieve gas and to trim the buoyancy compensator by means of handles or connection pull cords.

As a consequence, the foregoing invention provides a novel buoyancy compensator having a superior effect for buoyancy compensation and trimming of a diver's attitude in the water, while at the same time providing a more comfortable harness and superior filling means.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
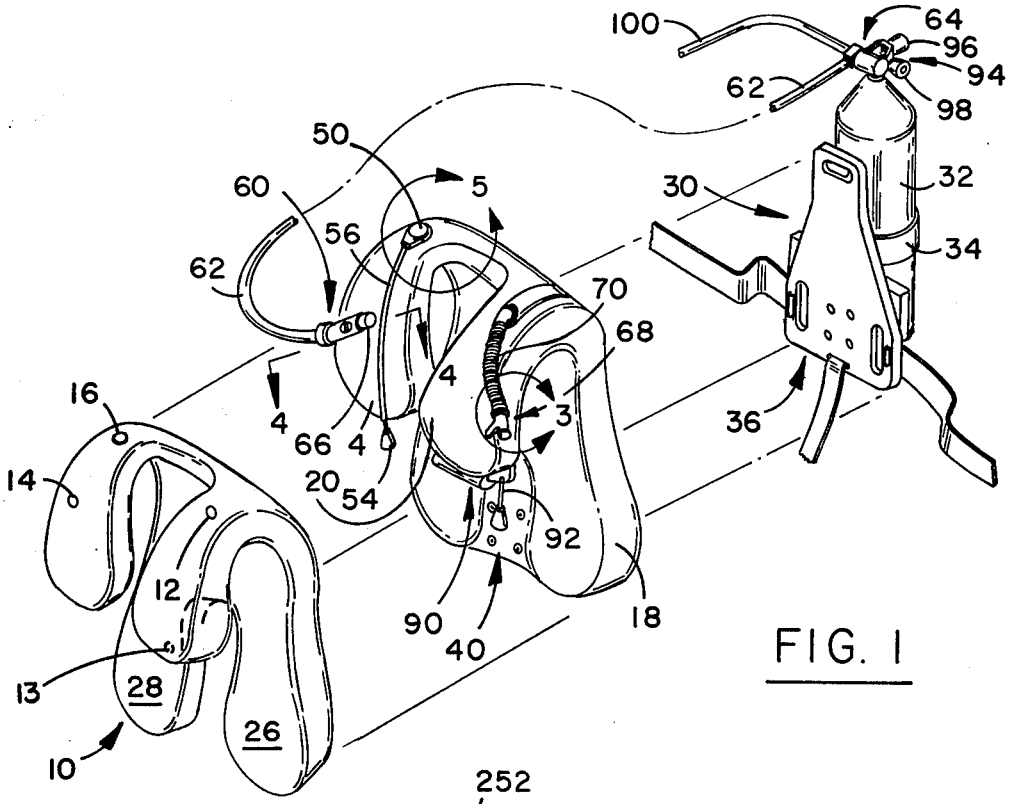
FIG. 1 shows a simplified embodiment of this invention with the bladder removed from the outside covering or casing of the buoyancy compensator wherein the major elements have been placed in an exploded extended relationship with respect to each other.

Looking at FIG. 1, it can be seen that a buoyancy compensator and backpack of this invention has been shown with ancillary or alternative embodiments, in the other figures.

FIG. 1 shows a bladder 10 with a plurality of ports 12, 13, 14 and 16. The bladder 10 is formed from a heat set polyurethane, but can be formed or any other type of flexible plastic or elastomeric sheet.

The bladder 10 fits into a casing formed of nylon duck fabric 18. However, the bladder 10 and fabric 18 can be a single walled chamber. The nylon duck fabric 18 is formed as a vest having respective left and right satchel portions 20 and 22 that overlie the chest of a user, and a main bladder portion at the back formed as respective left and right portions 26 and 28. However, any configuration is suitable, so long as there is front and back buoyancy support for balance.

The showing in FIG. 1 is of a continuous bladder void buoyancy compensator having a single or continuous bladder at the front and the rear thereof with overlying satchel portions 20 and 22. As will be explained later on in the specification, the satchel portions 20 and 22 can be formed as in FIG. 14, so that a yoke developed by the two satchel portions wraps around the neck of the user.

The showing in FIG. 1 includes for purposes or explanation, a backpack 30 which mounts a breathing gas tank 32. The breathing gas tank 32 is mounted by way of a strap 34, (see U.S. Pat. No. 3,957,183).

Figure 14:
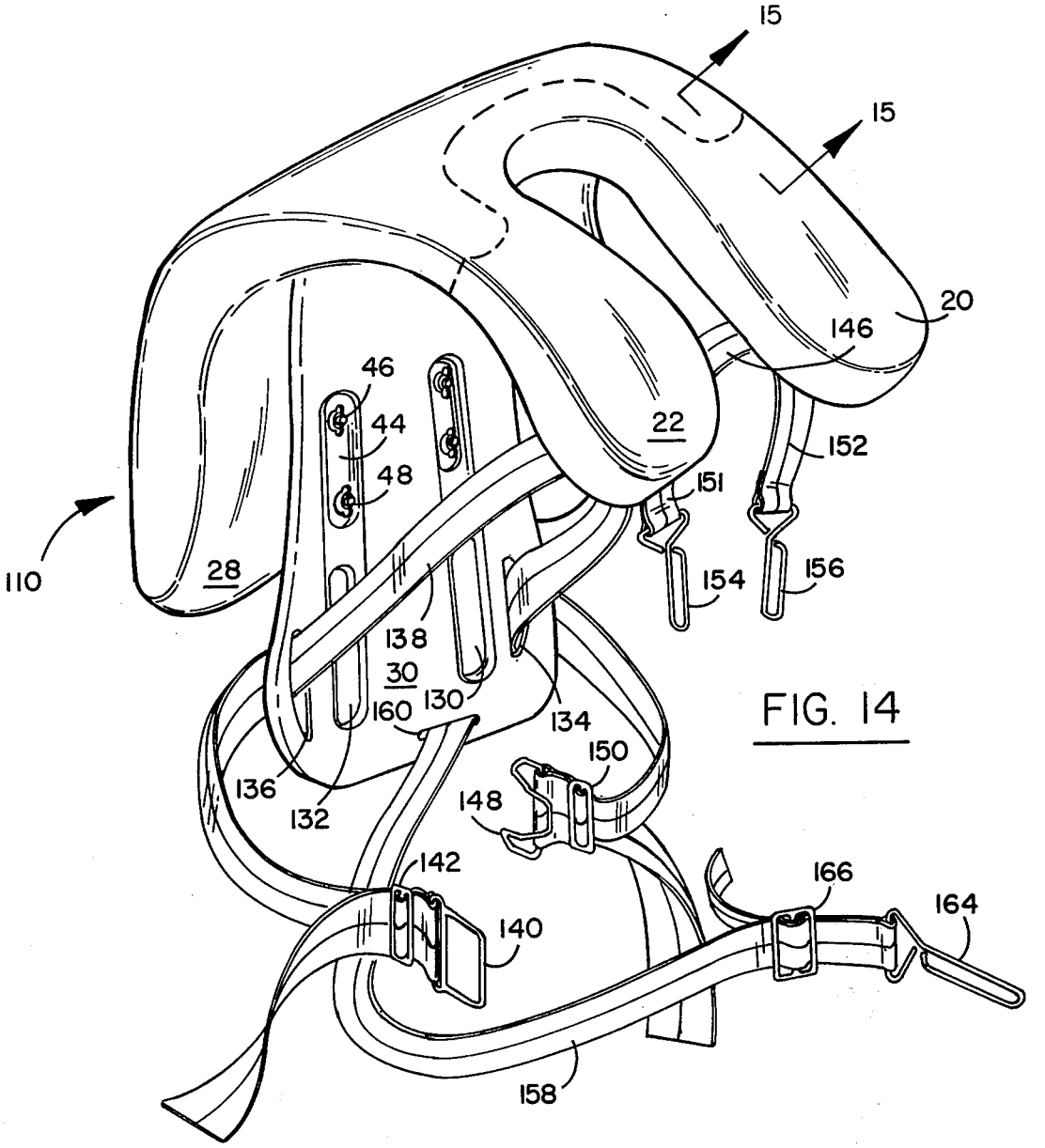
FIG. 14 shows a perspective view of the backpack and harness configuration including the buoyancy compensation; and, FIG. 15 shows a sectional view of the bladder interface between the front and rear bladders of the buoyancy compensator of this invention in the direction of lines 15—15 of FIG. 14.

The backpack 30 has a plurality of screw holes 36 which receive the openings of the vest 18 formed with grommets 40 therein. The backpack 30 is usually placed in front of the vest 18 looking from the left to the right. As seen in FIG. 14, it has been so implaced, but for purposes of expanded explanation, in FIGS. 1 and 8, it has been shown attached to the tank directly, so that one can view the inner portion of the vest material 18.

The backpack 30 is secured to the buoyancy compensator vest portion 18 by means of a plurality of cover plates 44 having bolts 46 extending therethrough, secured by wing nuts 48. In this manner, the backpack openings 36 are secured frontally to the grommet openings 40 of the buoyancy compensator so that the buoyancy compensator fabric lies behind the backpack and the backpack is in contact with the user's back. However, it should be understood that various modifications can be incorporated wherein the backpack is placed at the back of the buoyancy compensator 18 as well as at the front. The straps can be secured to the buoyancy compensator directly without the need of a backpack and the tank 32 secured to a separate backpack, or the compensator directly, without a backpack.

The buoyancy compensator vest 18 incorporates A dump and overpressure relief valve 50. The overpressure relief valve 50 has a lid or cover 52 thereon that is movable by means of a pull cord 54 extending through a plastic tube 56 that has been stitched to the nylon duck material. The tube 56 terminates in a manner to operate the lid or valve cover 52 by having an overcenter pulling effect thereon, with regard to a pivot upon which it rests.

The vest 18 incorporates a low pressure filling fixture 60 attached to a hose 62 that is in turn connected to the low pressure side of a first stage regulator 64. The low pressure inflator 60 has a button 66 that operates the low pressure system in the given embodiment of FIG. 1. However, the low pressure inflator of this specific buoyancy compensator varies from the showing of the other preferred embodiments of this invention. This inflator shall be expanded upon in reference to the detailed showing thereof in FIG. 4, hereinafter.

Figure 3:
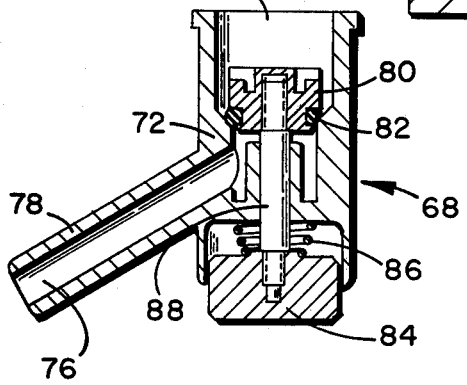
FIG. 3 shows a sectional view of the oral inflator inscribed within circle 3 of FIG. 1.

An oral inflator 68 attached to a flexible tube 70 is seated into the bladder of the buoyancy compensator. The oral inflator 68 is shown in detail as to its inflation means in FIG. 3. Since the oral inflator 68 is common to the other preferred embodiments, it should be noted as seen in FIG. 3 as to the details thereof.

In particular, the oral inflator 68 includes a housing 72 that attaches to the hose 70 at an opening 74. The housing 72 is formed from plastic and includes a mouth receiving a port 76 at an extended conduit 78 through which oral lung pressure is exerted to fill the vest or compensator 18. This is accomplished by releasing a valve member 80 sealed with an O Ring 82 against the valve surface of the housing. The actuation is performed by virtue of a button 84 having a spring loaded bias provided by a spring 86 thereon. The valve member 80 and the button 84 are respectively threaded to a stem 88 so as to be spring biased by the spring 86. The button 84 is depressed when oral pressure is exerted through the port 76 to fill the buoyancy compensator through the opening 74.

An emergency filling means is provided in the form of a $CO_2$ cartridge actuated device 90. The $CO_2$ cartridge actuated device utilizes a charge of gas with a puncture means provided by pulling a cord 92 having a handle thereon. The cord 92 operates a lever that has a sharp point that punctures a closure in the $CO_2$ cartridge in order to fill the buoyancy compensator or vest as is well known in the prior art. The filling is usually only when other sources of gas are not available, inoperative, or a rapid escape is required without the other sources of filling gas being available.

The entire buoyancy compensator backpack arrangement serves to support the breathing gas tank 32 with a valve 94 having a yoke with a handle 96, for securing the first stage regulator 64 thereto.

The handle 96 secures the first stage regulator 64 is a tightened sealed arrangement to the valve 94 which has a shut-off portion operated by a handle 98. In this manner, low pressure regulated gas from the first stage regulator 64 can be transmitted through the tube 62 for low pressure filling purposes, as well as through a second tube 100 which supplies a second stage breathing gas regulator. Also, tube 100 can supply a device incorporating a second stage breathing gas regulator for controlling and filling the buoyancy compensator by the utilization of exhaust gas, as later specified.

Figure 8:
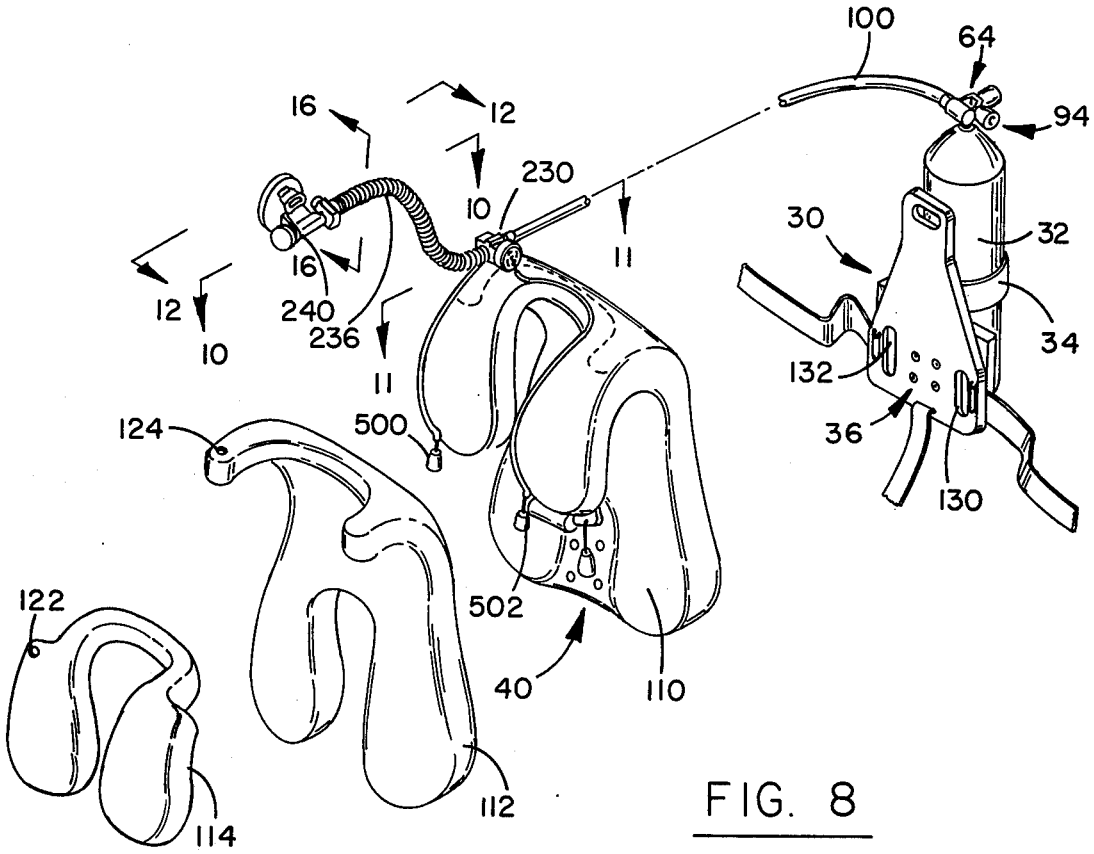
FIG. 8 shows an extended view of an alternative embodiment of this invention utilizing a second stage regulator having the exhaust function for purposes of filling the bladder and a separable front and back bladder.
Figure 15:
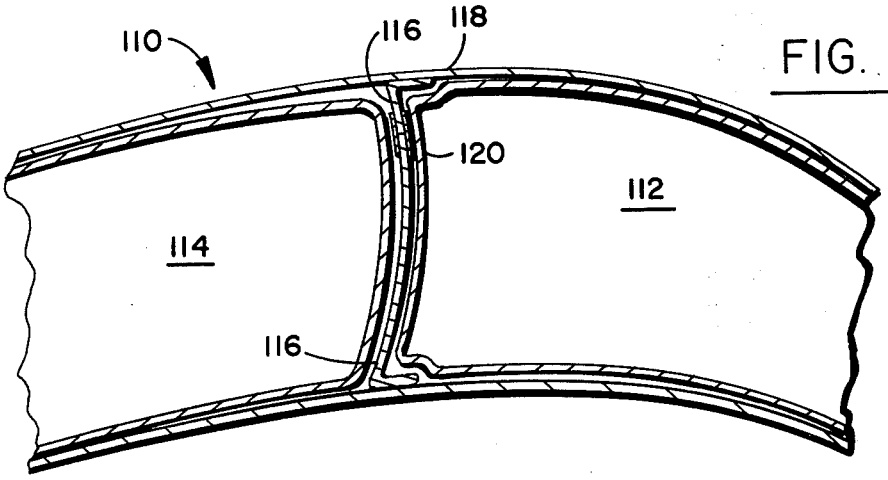

Looking more specifically at FIG. 8, an alternative embodiment of the vest is shown. A vest similar to the vest 18 is shown formed from a nylon duck material incorporating an outer duck vest 110 having a back inner bladder 112 and a front inner bladder 114 formed as a yoke. The bladders can be eliminated and the entire vest formed of one unitized gas tight walled chamber. The back and front bladders are shown more particularly in FIGS. 14 and 15 as to their interface. In order to reinforce and support the duck material, it can be seen that the vest 110 has an inner web 116 with a gusset 118 divided by a zipper 120 dividing the front from the back bladder. The zipper allows for replacement of the bladders as well as ease and general maintenance during the life of the buoyancy compensator vest 110.

The front and back bladders 112 and 114 can be utilized as in the showing of FIG. 1 when a manifold is provided between the two. In this manner, the operative features of the dump valve 50 low pressure inflator 62, oral inflator 68, and emergency gas inflation means 90 can be incorporated to either operate on a singular basis or in parallel with both the front and the back bladders. As can be seen, a through port 122 is shown in the front bladder 114 and a through port 124 is shown in the back bladder 112. These two respective openings are secured to a switching manifold and valving system that will be described.

The remaining portions, and the structural characteristics of the combination vest and compensator 110 in combination with the backpack 30 are fitted together generally as shown in FIG. 14 and similar to that of FIG. 1. The remaining portions as to the tank 32 and the supporting elements for breathing gas purposes and gas inflation purposes, remain fundamentally the same. The substantial difference resides within the double inflation means, and the other attendant devices that will be amplified upon hereinafter, as well as the concepts attendant with the dual bladders 112 and 114.

Looking more particularly at FIG. 14 and the harness arrangement, it can be seen that the buoyancy compensator vest 110 shown in FIG. 8 incorporates respective front, right, and left satchel portions. The satchel portions are depressed downwardly in the form of a yoke.

The compensator or vest 110 is secured by the bolts 46 and wing nuts 48 as previously described in cooperation with the backup plate 44 through the grommets 40 of the buoyancy compensator or vest. The backpack 30 is usually formed of a plastic or metal member. If it is formed from a plastic member it is customary to blow mold it with a hollow portion.

Handles 130 and 132 are provided for generally picking up the entire device. In addition to the handles, a pair of slots 134 and 136 are utilized for purposes of running a pair of straps therethrough, in particular, under the shoulder harness straps 138 and 146 are secured to the fabric of the vest 110 by means of stitching. The straps 138 and 146 pass through the openings 136 and 134. The strap 138 terminates with a loop 140 made of metal, which has a return member passing through a second loop 142. The lower shoulder strap 146 passes downwardly through the opening 134 which terminates in a hook member 148 which returns through a loop 150. Loops 150 and 142 are used for adjusting the strap.

The two respective shoulder harnesses 138 and 146 have downwardly depending continuing straps 151 and 152 that are also stitched to the underside of the buoyancy compensator or vest. Each one has a looped portion 154 and 156 that is formed with wire. The loops 154 and 156 receive the loop 140 which passes therethrough.

A crotch strap 158 is secured through an opening 160 of the backpack 30 and can be secured by an enlargement at the end thereof. The crotch strap 158 terminates in a loop 164 similar to loops 154 and 156 and has a return end passing through a belt type loop 166 for adjustment. The loop 164 can also pass over and receive the loop 140 for maintaining it in place. The foregoing description generally describes the harness configuration. Suffice it to say, the harness strap material can be made of a nylon webbing or other material that will provide a strong support.

A notable feature of this invention when the harness is fastened together in place, is that the weight of the backpack and its attendant load, including the tank 32, is uniquely loaded. The shoulder portions of the vest 110 are configured so that they receive the load with a pneumatic cushion, or at least a broad based pad when the vest 110 is not inflated. Also, the broad based pad in combination with downward pulling straps 151 and 152, eliminate the bind of the shoulder straps 138 and 146 where they pass under the armpit areas. Generally, the configuration of prior backpacks was such that they rode up into the armpit area, providing discomfort and binding of the entire harness.

To be more specific, the loops 154, 156 and 164 all pass over and receive the loop 140. The loop 140 is then secured over the return hook 148. Thus, all the loop openings 154, 156 and 164, are hooked onto the loop 140, which is attendantly hooked on the hook 148 when in use. This tends to draw the entire load downwardly. Thus, a downward pull loads the entire device, so that comfort is established and non-binding of the armpit areas is alleviated.

Ancillary to the buoyancy compensator arrangement of FIGS. 1 and 8, are a number of support devices. In particular, the support devices of the arrangement of FIG. 1, including the dump valve 50, the oral inflator 68, the emergency inflator 90, and the low pressure inflator 60. The foregoing can be used interchangeably between the two respective bladder embodiments of FIGS. 1 and 8. Of course, in the embodiment of FIG. 8, there would have to be a manifold connecting the front and rear bladders. A specific explanation of the foregoing support devices with respect to each entails an explanation firstly with regard to the low pressure inflator shown in FIG. 1.

Figure 11:
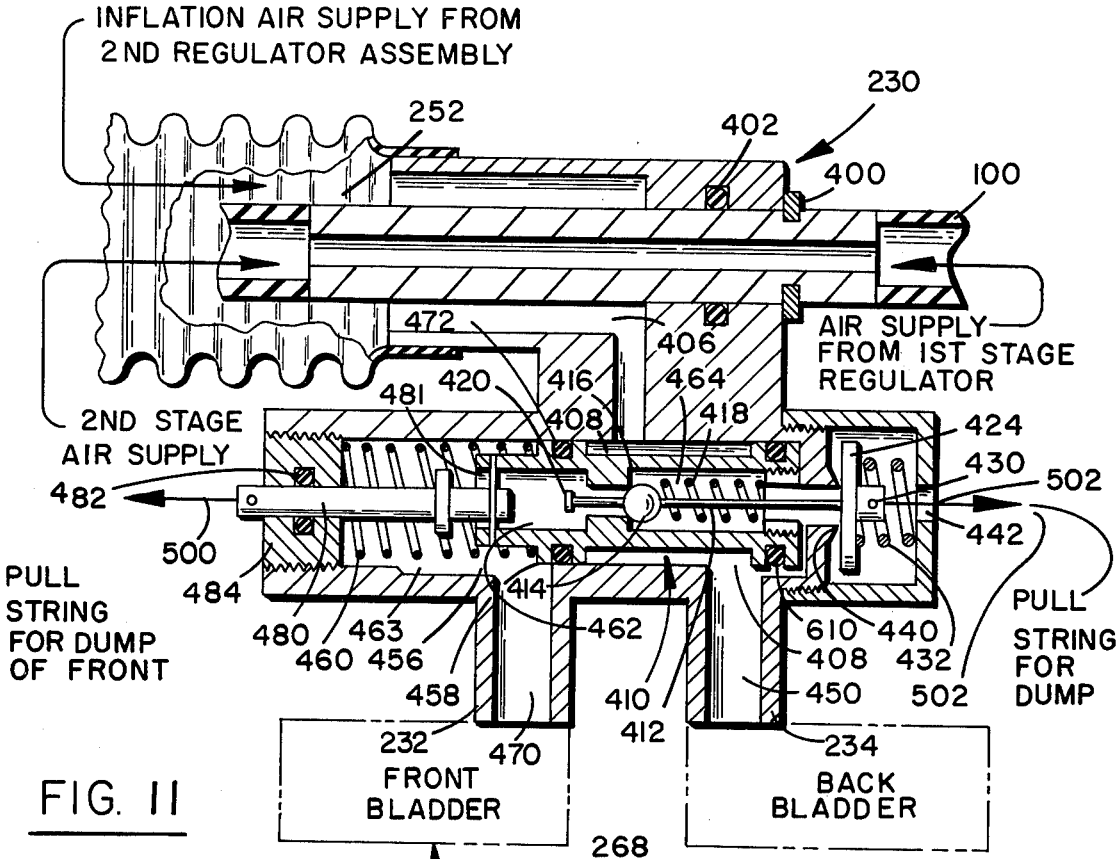
FIG. 11 shows a sectional view of the switching manifold and valving device of this invention in the direction of lines 11—11 of FIG. 8.

In particular, the low pressure inflator shown in FIG. 1 has been amply described in a prior art U.S. Patent of Leon A. Cerniway, et al., numbered U.S. Pat. No. 4,000,534. In that patent, the low pressure inflator has been shown in part, except for the latching device as described hereinafter with respect to FIG. 11 thereof. In FIG. 11 of the foregoing patent, it can be seen that a hose 22 having a shrader type valve end connection is inserted into the low pressure inflator. In like manner, the low pressure inflator 60 of this invention can be utilized wherein the end of the hose 62 having a shrader valve is inserted into an opening 170 of the low pressure inflator 60.

The insertion of the hose 62 is such that the shrader valve is thrust against the end of a stem 172. The stem 172 is threaded to a button 174 at the other end. Surrounding the stem 172 in an enlarged portion 173 thereof, is an O Ring 176 which seals the stem and the cavity 170, as well as the passage leading from the bladder 10.

Means for securing the low pressure inflator include a threaded nipple 180 having a slotted nut 182 thereon, which secures the low pressure inflator to the bladder. The nipple 180 has a passage 181 or bore, through which the stem 172 passes. The nipple 180 is turned over against the bladder 10 at point 186 in circumferential relationship, and a nut 188 is turned down thereagainst, in order to secure the inner and outer portion of the nipple 180 to the bladder 10. The button 66 is spring loaded by means of a spring 190 that biases the button 66 and the stem 172, so that the O Ring 176 seals off the interior passage to the nipple 180.

Figure 4:
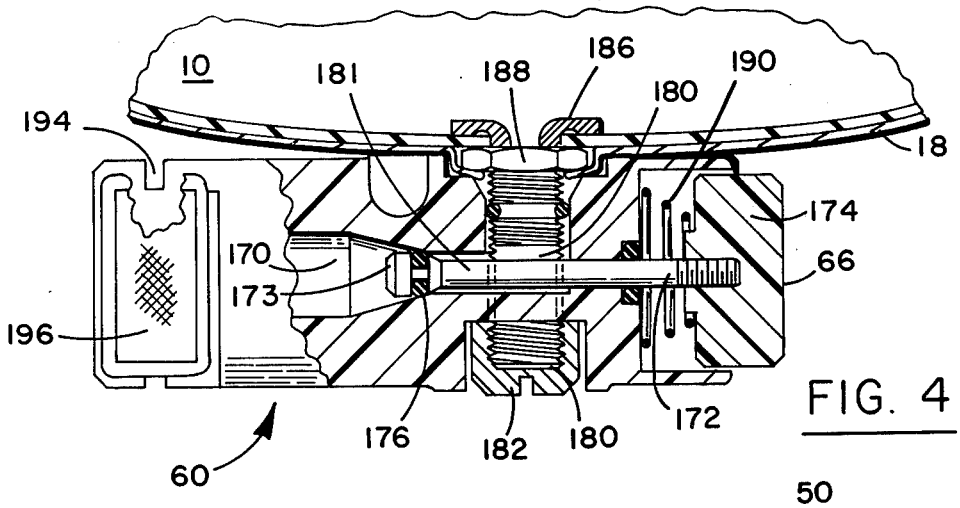
FIG. 4 shows a sectional view of an alternative low pressure inflator sectioned through lines 4—4 of FIG. 1.

The end of the hose 62 is inserted into the cavity 170 and held in placed by means of a U shaped member 194 engaging a groove in the hose fitting. The U shaped member circumscribes the base looking downwardly in the FIG. 4 showing and has a plastic button 196 connected thereto, which tends to lock the end of the hose 62 in place. The foregoing comprises the low pressure inflator that can be used to provide a flow of gas to fill the bladder 10 or the bladders 112 and 114 when a connecting manifold is provided.

Figure 5:
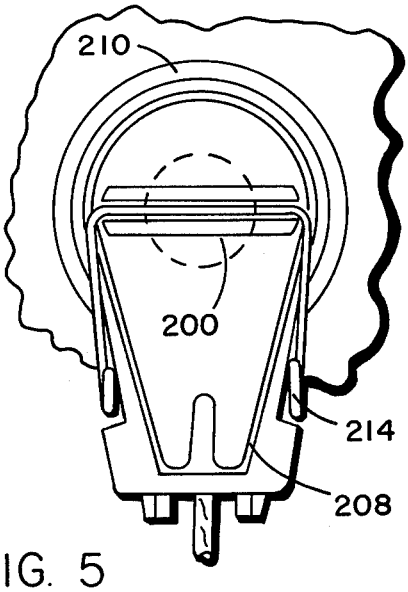
FIG. 5 shows a detailed plan view of the dump valve of this invention as scribed in circle 5 of FIG. 1.
Figure 6:
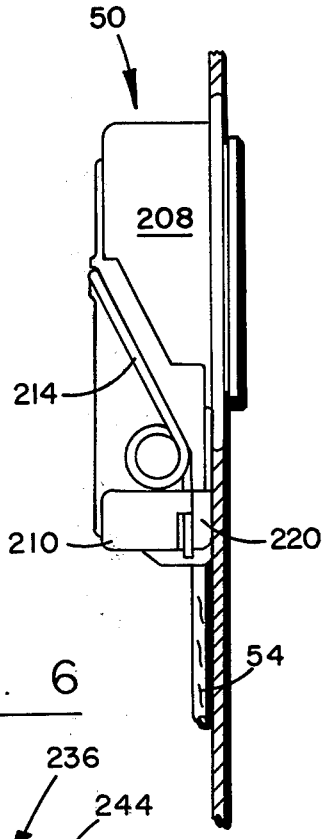
FIG. 6 shows a side elevation of the dump valve shown in FIG. 5.
Figure 7:
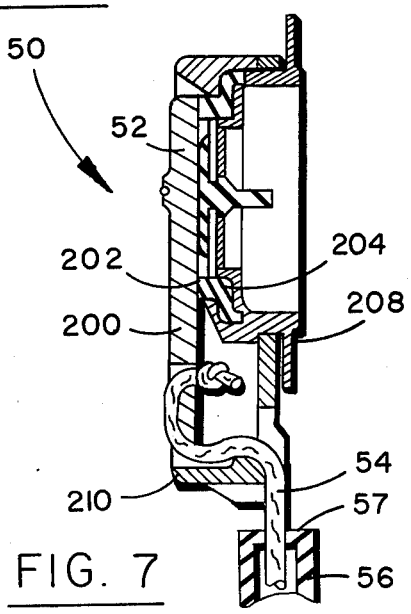
FIG. 7 shows a sectional view through the midline of the dump valve shown in FIG. 5.

The dump valve 50 shown in FIGS. 5, 6 and 7, has also been described in the previously mentioned patent. Suffice it to say, it comprises a cord 54 that is connected to a valve cover 200. The cord is knotted and passes through the valve cover 200 so as to rock the valve cover backwardly on a pivot point 202 provided by a seal formed as an S shaped cross section O Ring 204. The valve has a housing 208 that is seated and connected to the bladder by any suitable means. A circumferential round cap 210 is threaded downwardly onto the housing 208. A spring 124 having a loop therein, crosses the top of the valve cover 200 and is secured under a portion 220 of the housing 208. The entire configuration allows for the valve cover 200 to be lifted and rocked back when the cord 54 is pulled through the tube 56 which has a metal insert 57 therein in order to prevent binding.

The foregoing comprises the dump valve which can serve to relieve pressure when the internal gas pressure overcomes the spring pressure provided by the spring 214. Overpressure can be relieved, while at the same time, a trimming and release of pressure can be utilized to compensate for various buoyancy requirements by pulling on the cord 54 when manual articulation of the dumping valve is required.

As can be understood, the foregoing dump valve can be used on a manifold basis between the front bladder 114, and rear bladder 112 shown in FIG. 8. The valve 50 can be connected to a manifold to serve both or either through any valving and switching arrangement.

Looking specifically at the showing in FIG. 8 of a second stage regulator and connection means, it can be seen that the low pressure line 100 is connected to a switching manifold member 230. The switching manifold member 230 is in turn connected by two outlets 232 and 234 respectively to the front and back bladders 114 and 112 through respective ports 122 and 124.

Figure 16:
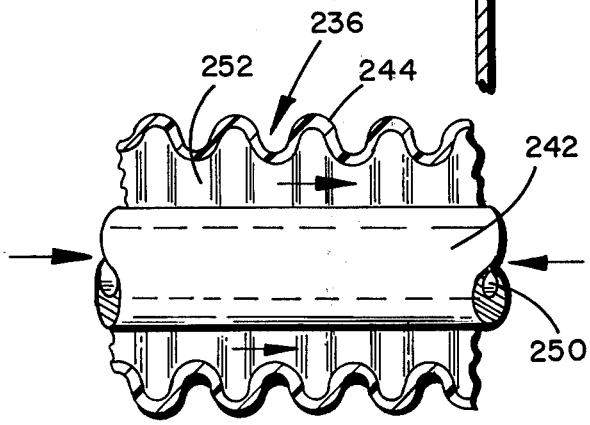
FIG. 16 shows a sectional view of the flexible coaxial hose.
Figure 12:
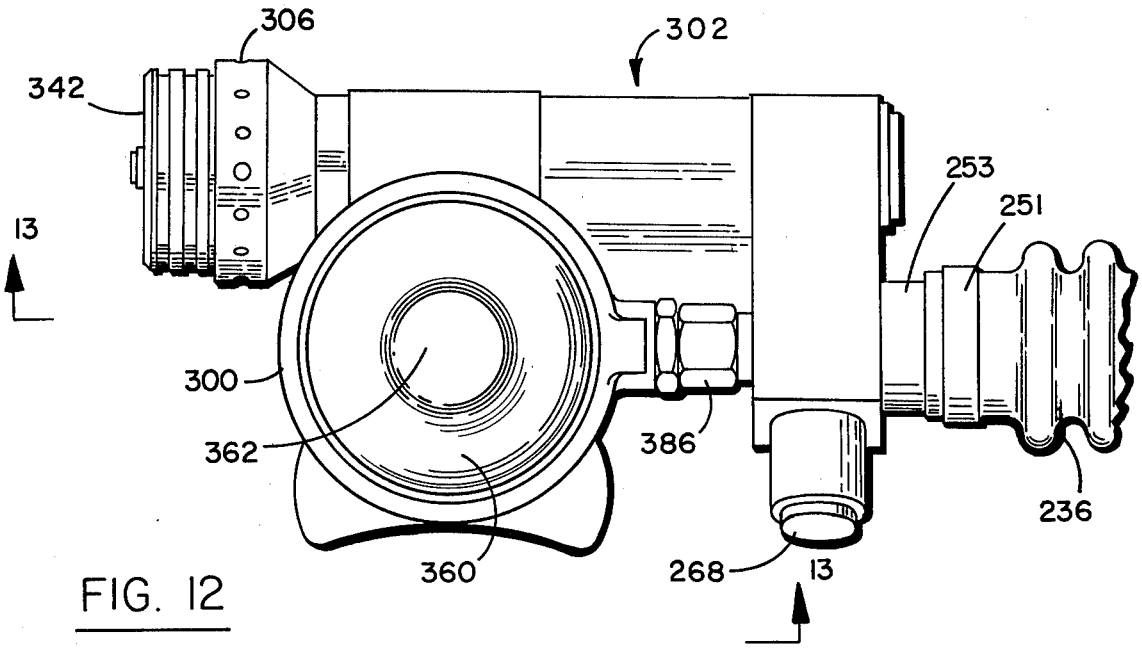
FIG. 12 shows a plan view of the second stage combination regulator and filling device of this invention in the direction of lines 12—12 of FIG. 8.

The switching manifold 230 is also connected by means of a hose 236, detailed in FIG. 16, to the combination second stage regulator 240 of this invention, which incorporates the exhaust buoyancy compensator filling means of this invention. The second stage regulator 240 is connected to the hose 236 in a manner whereby a coaxial relationship is established between an inner hose 242 and the outer wall of a flexible hose 244. The end result is to provide an inner passage 250 and an outer passage 252, as incorporated in the showing of FIGS. 11, 12 and 16.

Figure 10:
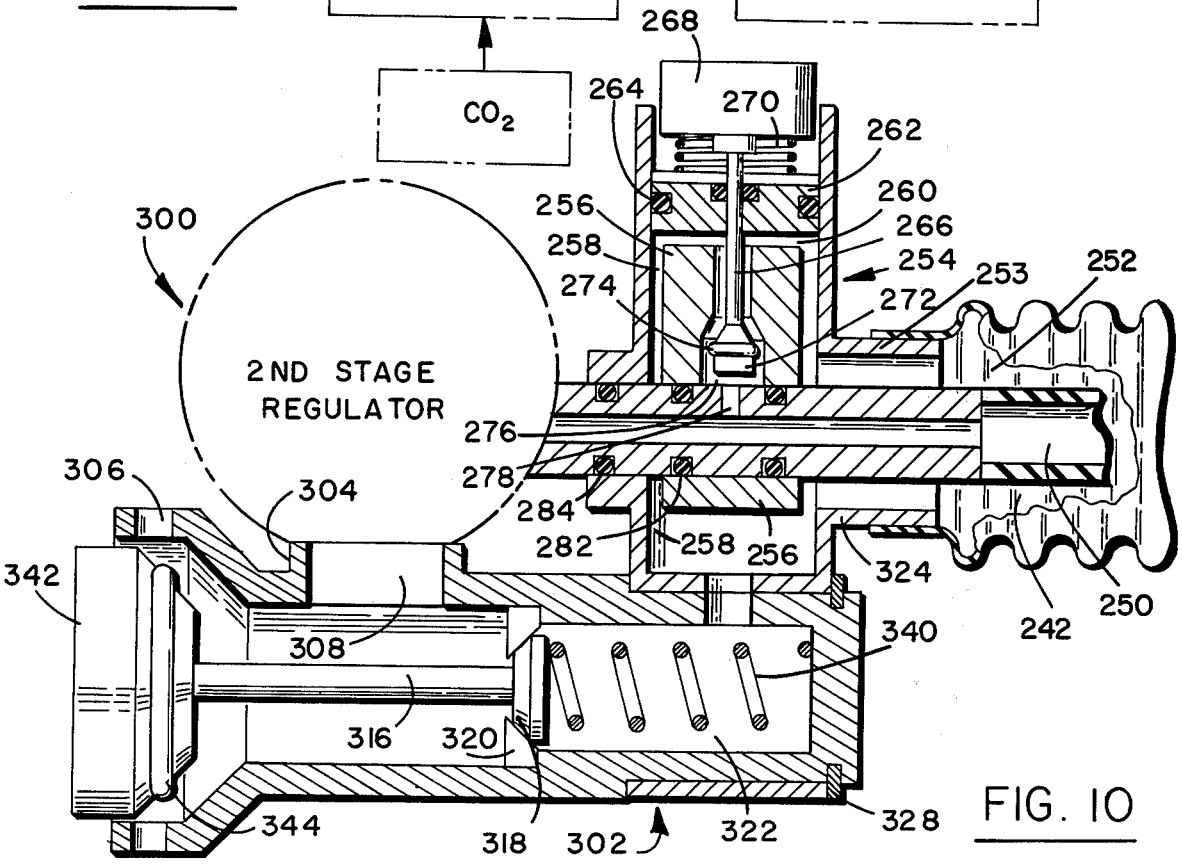
FIG. 10 shows a sectional view of the combination second stage regulator, valving and exhaust filling device of this invention in the direction of lines 10—10 of FIG. 8.

The hose 236 interconnects the switching manifold 230 to the second stage regulator apparatus 240 by means of a hose coupling or tie ring 251. The tie ring 251 secures the hose 236 to a tubular housing member 253, the tubular member 253 is connected to a valve housing member 254. The valve housing member 254 incorporates a cylinder 256 which has been cut along its sides to provide an inset 258 and a hole 260 has been bored through the top thereof, as seen in FIG. 10.

The cylinder 256 incorporates an upper portion 262 having an O Ring 264 for sealing it therein. A valve stem 266 has a button 268 threaded thereto and is biased by a spring 270. The valve stem 266 incorporates an enlarged end portion 272 with an O Ring 274 therearound for sealing a passage 276 therethrough.

The passage 276 interconnects with a second passage 278 to the inner hose passage 250 provided by the inner conduit 242. The conduit 242 is secured to the cylindrical member 256 by means of O Rings 282 and 284 therearound to prevent the passage of gas on an unwarranted basis. Thus, gas leading from the low pressure side of the first stage regulator 64 through the conduit 242 can be used to inflate the bladders 112 and 114 of the vest 110 by flowing backwardly through the outer space 252 and entering into the vest bladder cavities 112 and 114.

In normal operation, the conduit 242 is directly connected to a second stage regulator 300 that is mounted to a body 302. The body 302 has an upstanding annular portion 304 that receives the second stage regulator in secured relationship thereto. The second stage regulator can be of any particular form, so long as it regulates gas from the conduit 242 for breathing purposes in a manner to be described.

The body 302 incorporates exhaust ports 306 in connected relationship to the second stage regulator so that exhaust gas after breathing can escape therethrough. A void 308 passes all the way through the body 302 and is sealed as to air and ambient water by means of a stem 316 having a rubber valve cover 318 covering a valve seat 320. When the stem 316 moves to the right of the drawing of FIG. 10, it allows for the flow of gas, into a chamber 322 and into a second chamber 324. Gas can then pass to the passage between the outer hose 244 and the inner conduit 242, namely passage 252.

The body 302 is secured by means of a retainer ring 328 to the tubular housing member in a manner whereby it sufficiently supports the body and the remaining portion of the apparatus. The stem 316 is biased by a spring 340 that holds the valve stem cover 318 thereagainst, and is displaced by means of a button 342 having an O Ring 344 circumscribing a conical grooved portion thereof. The O Ring 344 seats up against the sloping side wall of the void 308 so as to shut off the flow of exhaust air from the second stage regulator. This allows the exhausted air to flow over the valve surface 320 into the void 322 and back through the space 252 to the switching manifold 230.

Figure 13:
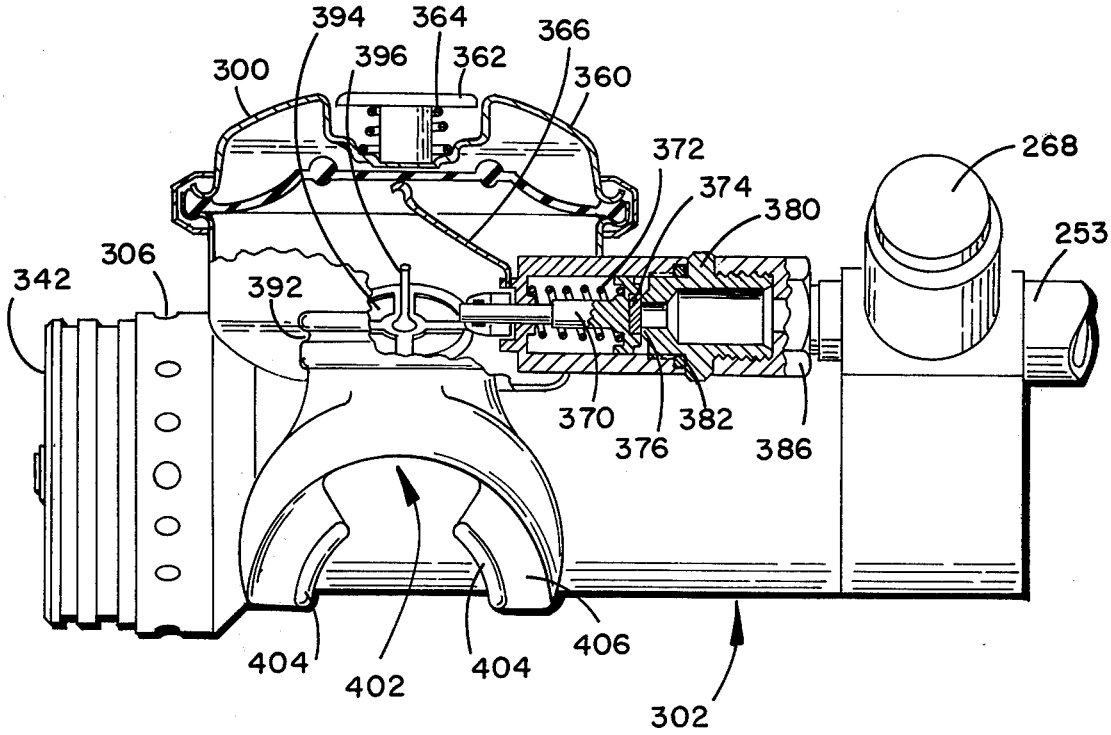
FIG. 13 shows a partial sectional view of the second stage regulator and exhaust filling device of this invention in the direction of lines 13—13 of FIG. 12.

The second stage regulator comprises an outer casing 360 having a purge valve actuator 362. The purge valve 362 is spring biased by a spring and an operating button 364 so that it can operate a lever 366, the lever 366 serves to toggle a stem 370 biased by a spring 372. When the stem 370 moves, it unseats a valve cover 374 provided by an elastomeric disc therein that is over a beveled valve surface 376. The toggle movement of the stem 370 for opening purposes is to the left as shown in FIG. 13.

An inlet fitting 380 incorporating the valve surface 376 is sealed by means of an O Ring 382. A brass nut 386 secures the assembly together.

A mushroom valve 394 prevents leakage until positive pressure is exerted thereagainst by having a thin elastomeric membrane spread across webs formed in quadrants and held in the center of the webs by an upstanding rubber stem 396. This provides a seal so that exhaust can flow through the openings, between the webs 392 when a positive pressure is exerted through either exhaling or pressing the purge valve 362. The entire assembly fits into the mouth by means of a bit or mouthpiece portion 402 having lugs 404 which are secured into a user's mouth for biting purposes across the surfaces 406 thereof.

From the foregoing, it can be seen that second stage regulator exhaust gas can flow into cavity 308 and backwardly into the bladder by flowing through passage 252 when button 342 is pressed downwardly, thereby sealing O Ring 344 against the surface of the housing 302.

By depressing button 268, low pressure gas can flow through the space 278 alongside the cylinder 256 through the grooves 258. Gas then flows into the space 324 to the space 252 between the inner and outer hoses 242 and 244 into the bladders 112 and 114. By opening the valve surface sealed by O Ring 274 in the foregoing manner, restricted flow passes along the foregoing path so as not to fully deplete the pressure to the second stage regulator.

The foregoing describes flow from the second stage regulator apparatus or assembly 240 to the switching manifold 230. The switching manifold 230 has been shown in numerous showings in order to capture the operative characteristics thereof in various modes.

The switching manifold 230 is connected at one end to the air supply from the first stage regulator 64 by means of the hose 100. The hose 100 is in turn connected to and passes through the switching manifold 230 with a retainer ring securing it in place, namely, retainer ring 400. The retainer ring 400 connects the tube 100 into the fitting, but can be connected to the fitting in any other suitable manner, and is sealed by an O Ring 402. The tube 100 can extend and form a portion of tube 242, or be interconnected in any other manner. The space 252 receives the gas that is provided either as exhaust from the second stage regulator, or by depressing the button 268 which returns the gas to a conduit or opening 406 which in turn connects to a space 408 surrounding a piston assembly 410.

The piston assembly 410 incorporates a long stem or rod 412 therein which slides through a ball member 414. The ball member 414 is urged against a surface 416 by means of a spring 418 biasing it thereagainst. The rod 412 has an enlarged end 420 which traps the ball 414 at one end. The rod is free to move inwardly and outwardly of the ball, and is in turn connected to a poppet 424 or valve cover that is in turn operated by a connection to the opening 430 and biased by a spring 432. The poppet valve surface 424 overlies a valve seat 440 that leads to an opening 442. The poppet can be operated by over pressure or by pulling at the opening 430, with a cord.

The passage 408 surrounding the piston assembly 410, is in connected relationship to the other side of the piston assembly 410 which has a connection to a port 450 through the conduit 234 connected to the back bladder. A second cavity 456 is shown in the housing at the other end of the piston assembly.

The piston assembly has a shoulder 458 that is biased by a spring 460. Additionally, the piston assembly 410 has a cavity 462 that allows the passage of gas inwardly and outwardly into a second cavity of the piston assembly 464 that are sealed from each other by means of the ball 414.

The spring 460 in the cavity 456 generally tends to place the conduit 450 and the second passage 470 in the conduit 232 in unconnected relationship by virtue of an O Ring 472 that seats against the outer surface of cavity 408. The spring 460 is connected to the piston assembly 410 at the shoulder 458 and is acted against by a rod 480 that has a seal provided by an O Ring 482 as it passes through a threaded insert 484.

The showing of FIG. 11 shows the gas flow from the second stage regulator assembly 240 to the switching manifold 230 as firstly received at cavity 408, to opening 450 and then to the back bladder 112. A pull string or cord on the outside of the vest 110, namely, cord 500 is connected to the rod 480. The opening 430 is connected to a second cord 502 through the opening 442 through the switching manifold assembly 230.

Figure 2:
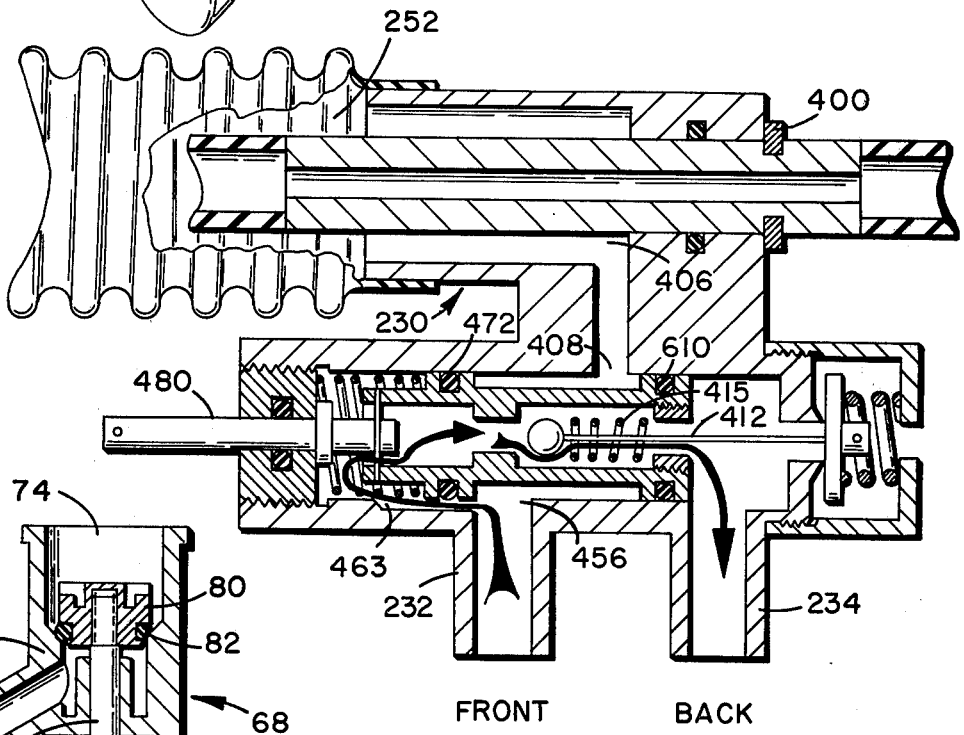
FIG. 2 shows a cross sectional view of the valving and switching manifold of this invention wherein the gas from a second stage regulator is used to fill the buoyancy compensator therethrough in one of its modes.
Figure 9:
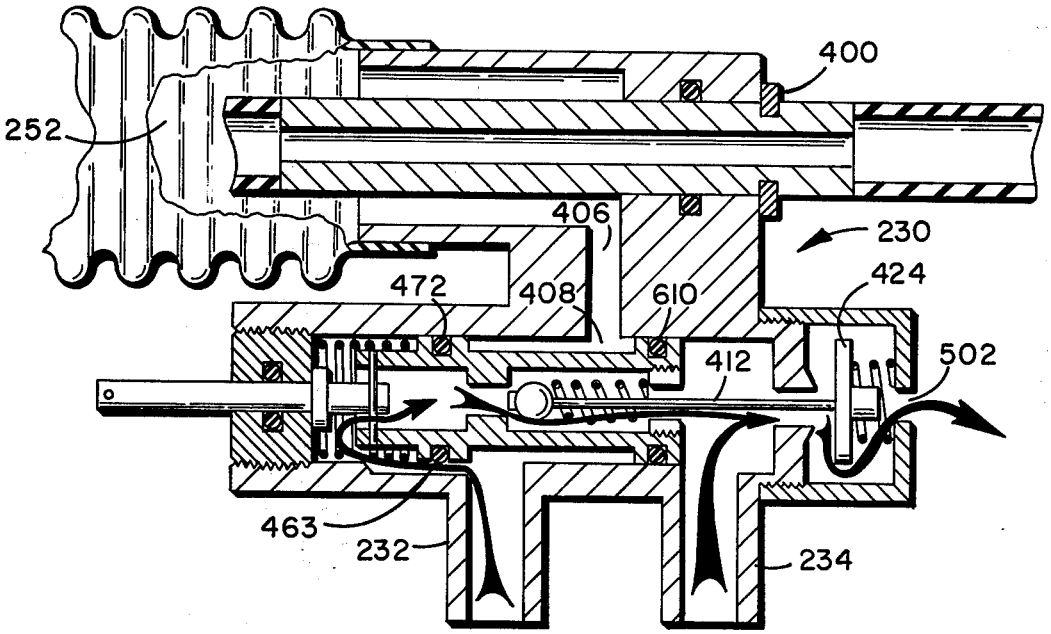
FIG. 9 shows an alternative view of the valving and switching manifold of this invention shown in FIG. 8 similar to the showing of FIG. 2, but in a different operating position.

The showings of FIGS. 2 and 9 indicate two alternative positions of the two foregoing related items. In particular, the showing of FIG. 2 indicates flow through the space 252 of the hose 236 to the manifold assembly. The flow then passes through the passage or conduit 406 downwardly and around the piston assembly 410 in a manner whereby it not only flows into the front bladder 114, but also into the rear bladder 112. This is due to the fact that the rod 480 has been pulled by the cord 500 so as to pull the piston assembly 410 to the left in the drawing.

The space 456 is sufficiently large enough to allow the passage of gas from the general area of the front bladder and passage 470 backwardly to overcome the pressure of the spring 418 against the ball 414. This is due in part to an undercut 463 in the housing beneath the piston assembly 410 which allows the passage of gas around the piston assembly. Thus, flow can come from the passage 406 into the front bladder, as well as the back bladder, by the cord 500 being pulled. The reason why this is accomplished, is that the poppet 424 remains in a closed position due to the fact that it is set to only open upon pulling of the cord 502 or when overpressure moves the poppet 424 off its seat 440.

In other words, the spring constant for moving the ball 414 from its seat or shoulder 416 by overcoming the force of spring 418, is of a value somewhat less than that required to move spring 432. The relative spring constant or force provided by springs 432 and 418 are set so that the gas pressure moves them both when the gas pressure against the ball 414 is greater than that which would normally move it from its position against shoulder 416.

Fundamentally, the second showing in FIG. 9 indicates a release or dumping of gas from both the front and rear bladders. This is done by moving the piston assembly 410 and the O Ring seal 472 to the area over the cutout 463 spaced below the piston assembly 410. The space or cutout 463 below the piston assembly allows for a free flow of gas between the passage 408 and the passageway 470 of the conduit 332. When the cord 502 is pulled, it serves the purpose of allowing flow out of the front and back bladder because of removal of the ball 414 from its shoulder or seat 460, as well as displacement of the poppet 424.

Thus, in operation, a filling of the back bladder 114 can take place by pressing either button 342 or 268 to allow the passage of gas through the passage 252 between the outer and inner walls of the hose 236. This will thereby allow the flow of gas into the back bladder.

If it is desired to fill the front bladder 114, the cord 500 is pulled to the left, thereby allowing the passage of gas to the front bladder when the gas is provided from assembly 240. This is due to a sealing of the back bladder by an O Ring 610 until sufficient gas pressure or pulling of cord 502 displaces the sealing ball 414. The sealing allows for the flow of gas into the front bladder by virtue of the fact that it passes through the passage 406 downwardly through the passage 408 and into the front bladder.

When the front bladder 114 is inflated to the point where the gas pressure can overcome the bias of the spring 418 to displace ball 414 backwardly, gas can also flow into the back bladder to the extent of the same pressure of the front bladder.

After the pressures in the bladders are sufficient to equalize the effect of the spring bias 418 which moves the ball back to the shoulder 416, a sealing of the front and back bladders can take place. This is done by releasing the cord 500 and allowing the piston assembly to slide back so that the O Ring 472 seals the passage 470 to the front bladder.

Continuous flow of gas from the passage 406 into the back bladder at this point, such as in the position exemplified in FIG. 11, continues to fill the back bladder until the pressure therein overcomes the pressure provided by the spring 432 against the poppet 424. Pressure in the back bladder can be released by pulling the cord 502 to the right to release any pressure therein without the requirement of pressure having to be greater than that required to remove the poppet 432 from the valve surface 440.

The showing of FIG. 9 indicates a dumping condition from the respective front and rear bladder by virtue of the two cords 502 and 500 displacing the poppet 424 and the piston assembly respectively.

The showing in FIG. 2 indicates a filling arrangement by virtue of the gas passing under the O Ring 472 through the undercut 463 and backwardly into the back bladder. The foregoing can take place when the ball 414 is displaced from its seat. It should be understood that by solely pulling the cord 502, a removal of the poppet 429 takes place, and this allows for a dumping of the back bladder. The ball 414 is not displaced until the inner facing surface of the end 420 engages the ball 414 and moves it off its seat at which time it can be removed and the fluid flow can take place therearound.

The head on the pin or extension, namely head 420 is fundamentally for trapping the ball and for moving it. Upon first movement of the cord 502, the poppet 424 is displaced, after which continued movement of the cord moves the rod sufficiently so that the head on the pin moves the ball 414 allowing for the previously referenced flow. The relative movement of the rod or pin 412 can be calibrated in any particular manner with respect to the poppet 424. Also, the head 420 can be utilized as a choke to check the passage of gas partially or in the entirety, depending upon its size and placement with respect to the opening it moves into when cord 502 is pulled.

As can be understood, various modes of operation can be utilized to fill and trim the respective front and back bladders with regard to various pressures depending upon the various requirements of a diver. The front bladder 114 and rear bladder 112 can be trimmed by pulling the respective strings 500 and 502, thereby either dumping the front or the rear. This hereby trims the respective bladders.

For clarity, it should be understood that a pin 481 which is connected to the piston assembly 410 passes through the piston assembly to allow for free flow between the passage 456 into the void 462 of the piston assembly and that there is no wall.

The showing of FIG. 9 shows the ball 414 displaced and the poppet removed while FIG. 2 shows the ball displaced and the poppet seated.

When the ball is not displaced and the cord 500 is pulled to the left, the flow of gas is directly into the front bladder 114. In other words, the front bladder 114 is filled by merely pressing one of the buttons 268 or 342 for providing low pressure gas with attendant pulling of the front cord 500.

The other modes of operation can include the utilization of a pressure relief mode, wherein the ball 414 is displaced sufficiently by pressure removing the ball from its seat. In the general configuration of FIG. 11, the ball is moved to the right under overpressure conditions. If at the same time, the back bladder 112 has sufficient pressure to move the poppet 424 without the aid of the cord 502, both the poppet and the ball 414 will unseat.

In addition to the foregoing, a valving system can be provided specifically so that when the cord 500 is moved to the left, it can be used to accommodate valving through a poppet valve that is actuated by a stem on the left hand side of the figures in the adjacent area of the fitting 484. In this manner, the front bladder by itself can be relieved of pressure without the necessity of providing any further functions.

As a consequence of the foregoing, it should be understood that this invention has broad application for filling purposes and for providing various alternative manifold switching means between a front and a rear bladder for purposes of trimming, relieving pressure, or filling or balancing the buoyancy compensator. As a consequence, this invention is only to be read in light of the following claims, which define the scope and spirit thereof.

I claim:

1. A unit for filling a buoyancy compensator comprising:

means adapted for connection to a second stage breathing gas regulator of the type used by an underwater diver;

a conduit connected to said connection means for conducting the flow of exhaust gas from said second stage regulator;

valving means interposed in the flow of exhaust gas for diverting the exhaust gas from said second stage regulator for flow into said conduit; and, means for connecting said conduit to a buoyancy compensator for inflation purposes.

2. The device as claimed in claim 1 wherein:

said means for diverting said exhaust gas comprises a port that is open when exhaust gas is to be exhausted freely; and, a spring biased closure means for closing said port having a seal attached thereto so that said exhaust gas can flow into said conduit.

3. The device as claimed in claim 2 comprising:

a valve that is operably connected to said conduit and said spring biased closure means which is in a normally closed condition until said exhaust diverting means is actuated, thereby opening said valve.

4. The device as claimed in claim 1 further comprising:

means in combination therewith including a conduit for causing the flow of low pressure breathing gas prior to entering the second stage regulator to flow to said buoyancy compensator.

5. The device as claimed in claim 4 wherein said means for causing the flow of low pressure breathing gas to said buoyancy compensator prior to being delivered to said second stage regulator comprises:

a valve member connected to said conduit normally in the closed position;

spring biasing means for closing said valve member;

manual connection means for operating said valve; and, a port from said valve to said conduit so that when said valve is open, the low pressure breathing gas can flow to said buoyancy compensator.

6. The device as claimed in claim 5 further comprising:

a coaxial conduit forming said conduit wherein said exhaust gas and said low pressure breathing gas used for filling said buoyancy compensator flow through a portion of said coaxial conduit; and, said low pressure breathing gas to be delivered from said breathing gas tank can be delivered through a second conduit in coaxial relationship thereto.

7. A buoyancy compensator and filling means therefor comprising:

a buoyancy compensator having a casing;

a bladder filling said casing for inflation;

a port connected to said bladder;

a conduit adapted for connection to the exhaust gases of a second stage breathing gas regulator and said port; and, means for valving gas into said buoyancy compensator through said exhaust conduit.

8. The filling means as claimed in claim 7 in combination with a buoyancy compensator having a front and back chamber; and, a manifold connected to said front and back chamber and to said conduit.

9. The buoyancy compensator as claimed in claim 8 further comprising:

valving means adapted to provide a flow of gas into one of said bladders; and, said valving means when placed in a second position serves to allow a flow of gas into a second bladder.

10. Apparatus to divert exhaust breathing gas that would be normally exhausted from a second stage breathing gas regulator to a buoyancy compensator for an underwater diver comprising:

a conduit connected to the casing of said second stage regulator;

means for valving the flow of gas from the casing of said second stage regulator into said conduit; and, means for connecting said conduit to a buoyancy compensator so that the exhaust gas from said second stage regulator can flow into the buoyancy compensator and cause the inflation thereof.

11. The combination of a second stage breathing gas regulator for an underwater diver and means for filling a buoyancy compensator comprising:

a second stage regulator for breathing gas having a casing;

means for providing gas to said casing;

means for valving gas into said casing from a high pressure source; and, mouthpiece means connected to said casing for providing a user with breathing gas that has been valved by said valve;

a conduit connected to said casing for diverting exhaust gas after it has been breathed;

means for valving exhaust gas for flow through said conduit;

means for connecting said conduit to a buoyancy compensator to cause said buoyancy compensator to be filled by exhaust gas from said second stage regulator.

* * * * *

UNITED STATES PATENT AND TRADEMARK OFFICE

Certificate

Patent No. 4,137,585 Patented February 6, 1979

William Milton Wright

Application having been made by William Milton Wright, the inventor named in the patent above identified, and U.S. Divers Co., Santa Ana, Calif., a corporation of Calif., the assignee, for the issuance of a certificate under the provisions of Title 35, Section 256, of the United States Code, adding the name of Earl V. McNeil as a joint inventor, and a showing and proof of facts satisfying the requirements of the said section having been submitted, it is this 7th day of July 1981, certified that the name of the said Earl V. McNeil is hereby added to the said patent as a joint inventor with the said William Milton Wright.

Fred W. Sherling
*Associate Solicitor.*